US005665947A

United States Patent [19]

Falcon

[11] Patent Number: 5,665,947

[45] Date of Patent: Sep. 9, 1997

[54] CABLE ACTUATED SWITCHING MECHANISM WITH MECHANICAL SNAP ACTION CAPIBILITY AND BROKEN CABLE MONITORING CAPABILITY

[75] Inventor: David E. Falcon, Oak Creek, Wis.

[73] Assignee: Honeywell, Inc., Minneapolis, Minn.

[21] Appl. No.: 575,568

[22] Filed: Dec. 20, 1995

[51] Int. Cl.[6] ..... H01H 17/00

[52] U.S. Cl. ..... 200/61.18; 200/543; 200/573

[58] Field of Search ..... 200/5 R, 16 R, 200/16 B, 16 C, 16 D, 17 R, 18, 19 R, 33 R, 33 D, 52 R, 43.07, 61.13–61.18, 43.13, 61.41, 61.42, 502, 520, 537–546, 573, 574, 318, 318.1

[56] References Cited

U.S. PATENT DOCUMENTS

| | | | |
|---|---|---|---|
| 3,870,846 | 3/1975 | Filip | 200/161 |
| 3,956,606 | 5/1976 | Reiter | 200/161 |
| 4,306,126 | 12/1981 | Howard | 200/52 R |
| 4,396,815 | 8/1983 | Kobayashi et al. | 200/161 |
| 4,458,122 | 7/1984 | Knight | 200/153 LA |
| 5,003,135 | 3/1991 | Piccoli | 200/52 R |
| 5,041,705 | 8/1991 | Piccoli | 200/52 R |

*Primary Examiner*—Cassandra C. Spyrou
*Assistant Examiner*—Michael A. Friedhofer
*Attorney, Agent, or Firm*—William D. Lanyi; John G. Shudy, Jr.

[57] ABSTRACT

A cable switch actuating mechanism is provided with a shaft and a cam structure that slides on the shaft. When the associated cable is pulled to exert an axial force on the shaft, the cam actuator is pushed by the shaft into a deactuating position that moves a switch operator plunger against a plunger of an associated electrical switch. If the cable breaks, the reduction enforced on the shaft causes an internal spring to move the shaft against the cam structure and, as a result, move the switch operator into its deactuating position. Appropriate gaps between the opposite ends of the cam structure and associated surfaces of the shaft allow for thermal expansion and contraction of the cable without adverse affects on the mechanism.

20 Claims, 5 Drawing Sheets

CABLE ACTUATED SWITCHING MECHANISM WITH MECHANICAL SNAP ACTION CAPIBILITY AND BROKEN CABLE MONITORING CAPABILITY

BACKGROUND OF THE INVENTION

1. Field of the Invention

The present invention is generally related to cable actuated switches and, more specifically, to a cable actuated switching mechanism that is able to lock the mechanism in place upon actuation and actuate switch contacts also lock the mechanism in place in response to a broken cable.

2. Description of the Prior Art

Many types of cable actuated switches are known to those skilled in the art. Cable actuated switches are typically used in applications where an emergency stop capability is required along an extended distance. For example, in certain conveyor system applications, it is necessary to provide a means for operators to actuate the emergency stop condition from many different locations along the conveyor. Rather than provide numerous emergency stop switches at multiple locations along the equipment, it is economically advantageous to provide a single switch that can be actuated by pulling a cable that extends along the conveyor from the switch to a remote location.

U.S. Pat. No. 3,870,846, which was issued to Filip on Mar. 11, 1975, discloses a cable activated switch that comprises a switch support body that has a through bore. A first switch contact member is retained on the body and a second switch contact member is further slidingly retained on the body and insulated therefrom. Clamping means are provided for securing the cable passing through the bore. First resilient means are provided to bias the contact members. The first and second contact members are displaced relative to each other by predetermined axial movement of the cable which passes through the support body.

U.S. Pat. No. 5,003,135, which issued to Piccoli on Mar. 26, 1991, describes a cable controlled electrical safety switch device that comprises a piston tensioning cable under the action of a spring via a rod and a screw thread for adjusting the tension of the spring and of the cable. A piston groove actuates a push member for the switch. The piston is angularly adjustable. The flank of the groove remote from the spring is helicoidal. When the cable is long, a high tension is selected so that the groove flank moves away from the push member. This distancing is desirable in order that any length variations due to heat, which are greater with a long cable, may be prevented from triggering the switch. The clearance between the other flank and the push member is then corrected by rotation of the piston.

U.S. Pat. No. 4,396,815, which issued to Kobayashi et al on Aug. 2, 1983, discloses an emergency switch for preventing an accident in a mechanism employing a control cable. It comprises a casing having a pair of contacts at opposite inner side surfaces thereof and an insulator member having a movable contact. The insulator member is slideably and axially moved within the casing in connection with tensile force of inner cables. When the inner cables become unoperable because of some problem, the movable contact is touched to the contacts provided on the inner side surfaces of the casing in order to detect the problem or to stop the movement of the mechanism.

U.S. Pat. No. 3,956,606, which issued to Reiter on May 11, 1976, describes a cable operated safety stop switch. The switch unit, which is suitable for use in instances of emergency and also for a normal electrical shut off and resetting of a controlled system, features a snap action electrical switch. The switch can be operated selectively by a pair of like end anchored tension cables which have their inner ends connected to the operating and reset signal arm in order to trip the latter from a normal release position upon a tensioning of either cable by an attendant. The tripping of the arm causes it to operate the snap action switch and the arm is automatically locked in the tripped position thereof. A tensioning of either one of the cables under a force exceeding a very moderate value occasions a limited rotation of a shaft carrying the arm. This actuates the snap action switch and thereby through conventional wiring means initiates an instantaneous cut off of the system's electrical supply. The shaft and the arm are automatically locked in their tripped condition by a locking plate fixed on and rotatable with the shaft. The plate presents locking pins adapted to engage the latch in a fixed keeper plate of the switch unit. The locking plate is axially movable with the shaft in opposition to relatively mild spring bias to disengage the locking pins from the keeper plate. It thereby releases the shaft for normal counter rotation from locked condition to normal release condition.

Several problems are common with known cable actuated switch mechanisms. For example, if the switch actuation mechanism does not provide a mechanical snap action, or locking capability, a slight tension placed on the cable can momentarily change the status of the associated switch, but then return the switch to its original status when the tension on the cable is released. In certain circumstances, the switch associated with the mechanism may not be electrically connected in such a way that it automatically turns off all associated devices in response to a momentary deactuation of the switch. In this event, the release of the cable can then reactivate the associated machinery and cause physical harm to the operator. It would therefore be significantly advantageous if a mechanism could be provided that mechanically locks the mechanism in a deactivated condition as soon as the switch is deactivated and, in turn, require a positive action on the part of the operator to reset the switch following this type of circumstance.

Another problem that can occur with cable actuated switching mechanisms is the occurrence of a broken cable. When a cable breaks, an operator is unable to activate an emergency stop switch when a subsequent emergency occurs. It would therefore be advantageous if a switch mechanism could be devised in such a way that a broken cable situation causes a response which is similar to the mechanism's response to an emergency stop situation.

When long cable lengths are used in association with a cable actuated switch, changes in temperature can activate or deactivate the switch because of the resultant changes in the length of the cable as a result of the cable's thermal coefficient of expansion. With regard to the expansion or contraction of the cable as a result of temperature change, it is much more common for the cable to experience temperatures that are much higher than to experience those when the cable was initially installed than the opposite condition caused by falling temperatures. This occurs because many applications of cable actuated switches are used in circumstances, such as warehouses, where heating is provided for winter conditions, but air conditioning is not provided for summer conditions. As a result, heating systems are able to maintain the apparatus at normal operating temperatures during winter months, but no air conditioning systems are provided to maintain the apparatus at normal operating temperatures during summer months. As a result, the cables can expand beyond their normal lengths during summer months.

It would therefore be significantly beneficial if a cable actuated switching mechanism could be provided which addresses these problems.

SUMMARY OF THE INVENTION

The present invention provides a cable actuated switching mechanism that comprises a housing structure and a shaft which is slideably disposed within the housing structure. The shaft is movable relative to the housing structure along a first path in a direction parallel to an axial centerline of the shaft. This movement is in response to a force exerted by a cable attached to an end of the shaft. The present invention further comprises a cam structure that has an opening formed therethrough. The opening, or bore, is shaped to receive the shaft therein in slideable relation with the cam structure. A switch operator is movable along a second path between a first position and a second position in response to movement of the cam structure in either a first direction or a second direction along the first path. In addition, a preferred embodiment of the present invention comprises a means for locking the switch operator in the second position after the switch operator moves into the second position.

In a preferred embodiment of the present invention, it further comprises an electrical switch attached to the housing structure. The switch is actuated when the switch operator is in the second position and deactuated when the switch operator is in the first position. A typical switch that can be used in conjunction with the present invention is one that is identified as Catalog Number CLSB4A which is available in commercial quantities from the MICRO SWITCH division of Honeywell Incorporated. In a typical application of the present invention, the switch is a normally closed switch that is connected in series with electrical power provided to potentially hazardous equipment.

In a preferred embodiment of the present invention, it further comprises a first means for moving the cam structure in the first direction in order to move the switch operator into the second position in response to the force increasing beyond a first threshold magnitude. It also comprises a second means for moving the cam structure in the second direction in order to move the switch operator into the second position in response to the force decreasing beyond a second threshold magnitude. The first moving means can comprise a first enlarged portion of the shaft which is shaped to push the cam structure in the first direction in response to movement of the shaft in the first direction. The second moving means can comprise a second enlarged portion of the shaft which is shaped to push the cam structure in the second direction in response to movement of the shaft in the second direction. The second moving means can further comprise a spring for pushing the shaft in the second direction in response to the cable force decreasing beyond the second threshold magnitude.

A preferred embodiment of the present invention further comprises a means for resetting the mechanism by urging the cam structure in the first direction in order to move the switch operator from the second position to the first position. In a particularly preferred embodiment of the present invention, the first path is perpendicular to the second path. In addition, the switch operator comprises a cam follower that is disposed in contact with the cam structure. The locking means of the present invention can comprise a sphere that is disposed in contact with the cam structure.

BRIEF DESCRIPTION OF THE DRAWINGS

The present invention will be more fully and completely understood from a reading of the Description of the Preferred Embodiment in conjunction with the drawings, in which.

DESCRIPTION OF THE PREFERRED EMBODIMENT

Figure 6:
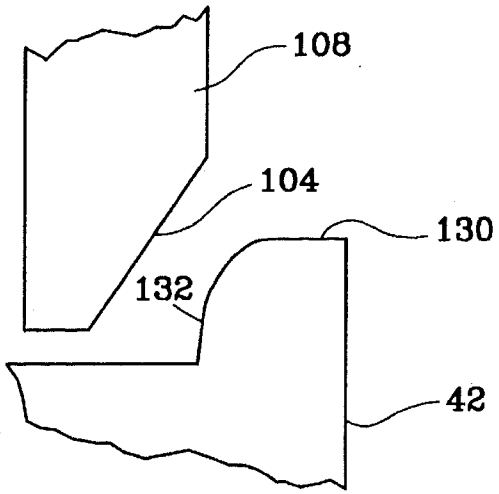
FIG. 6 is a detailed illustration of a portion of a cam actuator and a reset plunger in a preferred embodiment of the present invention.

Throughout the Description of the Preferred Embodiment, like components will be identified by like reference numerals.

Figure 1:
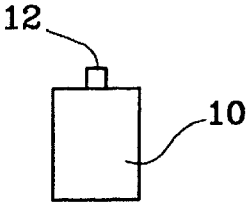
Fig. 1 (PRIOR ART)
FIG. 1 is a simplified illustration of a switch with a plunger.

FIG. 1 shows a schematic representation of a switch that is generally known to those skilled in the art. The switch has a body 10 and a plunger 12 that is depressed in a direction toward the body in order to activate the switch. In the description of the preferred embodiment, the mechanism of the present invention will be described in terms of association with a normally closed switch 10. Therefore, depression of the plunger 12 by the present invention will cause the switch to disconnect contacts within its structure and open an electrical circuit. In contrast, release of the plunger 12 to move under spring actuation provided by the switch will cause the contacts to close. Switches of the type shown in FIG. 1 are widely known to those skilled in the art and many types of normally closed switches are available in commercial quantities. The switch 10 can be a snap acting switch, but the mechanical locking capability of the present invention is equally applicable with show acting switches.

Figure 2:
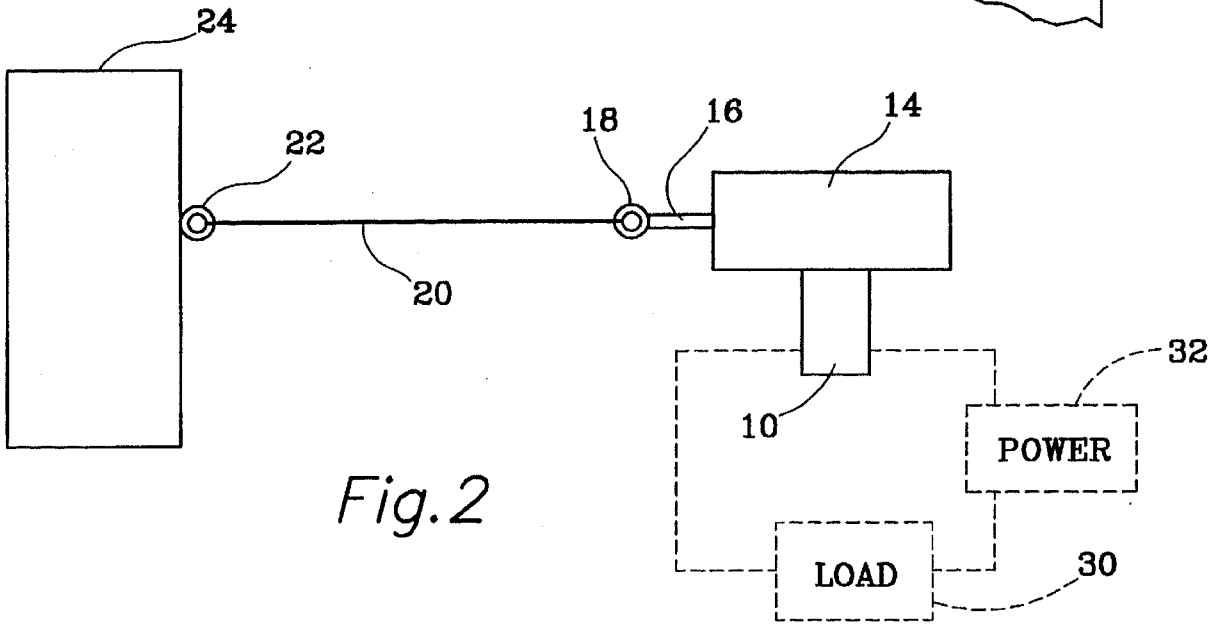
FIG. 2 is a schematic illustration of a cable switch actuator and a cable.

FIG. 2 shows a cable operated switching mechanism 14 associated with a switch 10. A shaft 16 extends from the housing structure 14 of the mechanism. An attachment means 18 is provided for permitting a cable 20 to be attached to the shaft 16. A similar attachment means 22 is provided to permit the cable 20 to be attached to a rigid device 24 which can be a portion of a machine or any other stationary component. The length of the cable 20 can be very long. In some cases, cable actuated switches are used in conjunction with cables that are over 200 feet long. Any operator working near the cable 20 can pull it to deactivate the equipment associated with the switch 10. As an example, a load 30 is shown by dashed lines in FIG. 2 connected in series with the switch 10. When the cable 20 is pulled, shaft 16 moves axially with respect to the housing structure 14 and the switch 10 is deactuated. This disconnects the load 30 from a source of power 32. In this way, the mechanism provides a means by which several operators dispersed along the length of a machine can all deactuate power to the machine by pulling on the single cable 20.

Figure 3:
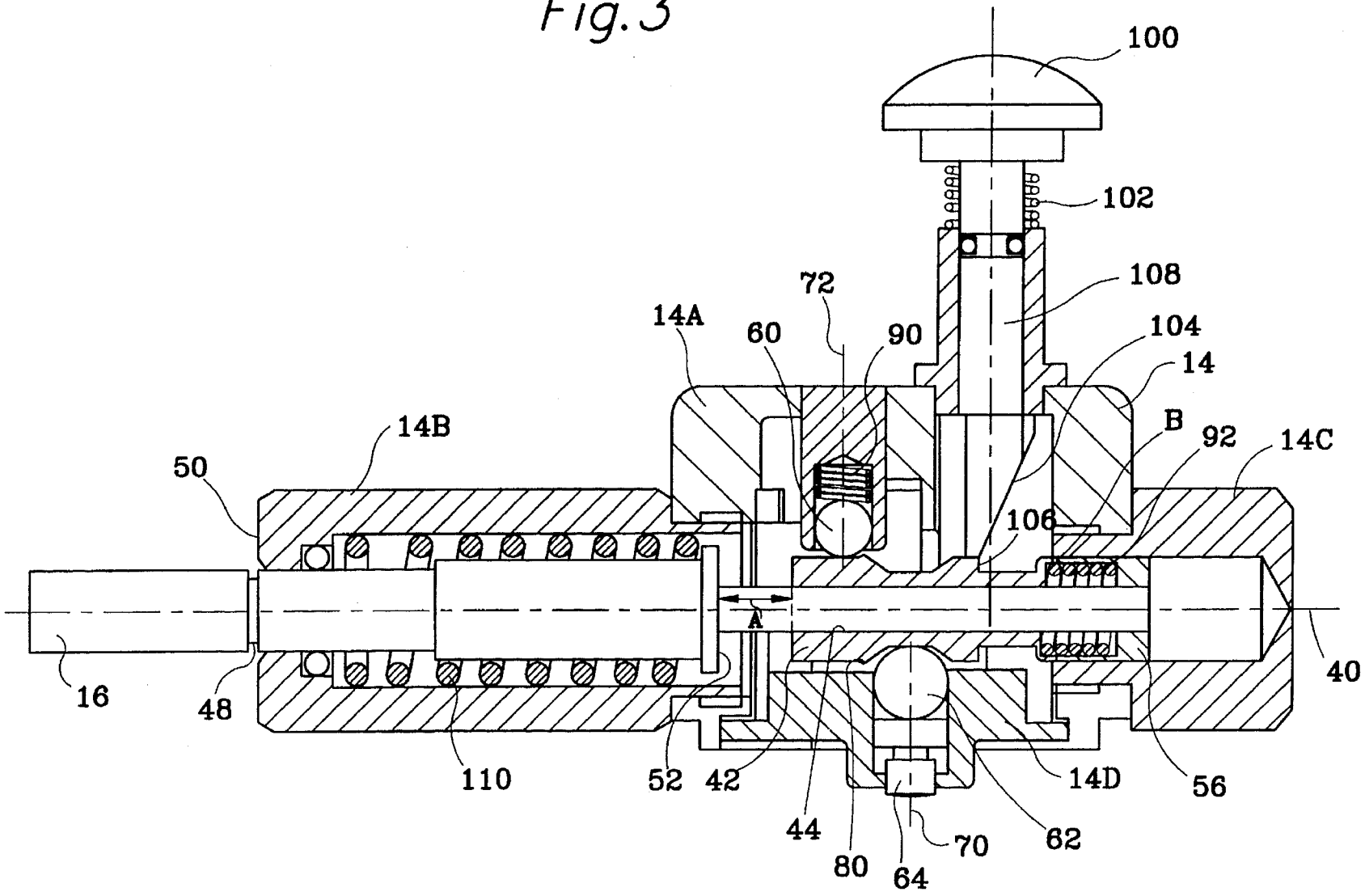
FIG. 3 is an illustration of the present invention in an operating configuration.

FIG. 3 is a section view of a preferred embodiment of the present invention. A housing structure 14 is provided. In the embodiment of the present invention shown in FIG. 3, the housing structure comprises a central portion 14A, one end portion 14B and another end portion 14C. In addition, a bottom portion 14D is provided to facilitate assembly of the structure shown in FIG. 3. The use of these individual components to form the housing structure facilitates the assembly of the internal components of the present invention. A shaft 16 is slideably disposed within the housing structure 14. The shaft 16 has a central axis 40 and the shaft is disposed within the housing structure 14 to permit it to slide relative to the housing structure along the direction parallel to the central axis 40. A cam structure 42 is provided with a central opening 44 formed therethrough. The central opening 44, or bore, is shaped to receive a portion of the shaft 16 in slideably relation therein. In other words, the cam structure 42 can move axially in the direction parallel to central axis 40 relative to the shaft 16. The shaft 16 is provided with an indicating groove 48 which identifies a preferred axial position of the shaft 16 in order to facilitate set up and installation of the present invention and its associated cable. When the indicating groove 48 is generally aligned with the end 50 of the housing structure 14, the shaft 16 is in its proper position.

The cam structure 42 can move axially relative to shaft 16 between two limits. A cam stop surface 52 prevents the cam structure 44 from moving farther than its location at the left extreme portion of the cam structure's travel. At the opposite end of the cam structure's travel, an end stop 56 is attached to the shaft 16.

As can be seen in FIG. 3, the cam structure 42 is provided with various specifically shaped surface portions that perform important functions in the present invention. These cam surfaces cooperate with a locking ball 60 and an operating ball 62. The operating ball 62 is associated with an operating plunger 64. In the terminology used to describe the present invention herein, the operating plunger 64 is also referred to as the switch operator. The switch operator 64 is movable along a second path relative to the housing structure 14 in a direction generally parallel to line 70. The locking ball 60 is movable relative to the housing structure 14 in a direction generally parallel to line 72. The locking ball 60 and the operating ball 62 operate as cam followers in response to movement of the cam surface of the cam structure 42. In other words, as the cam structure 42 moves left and right along central axis 40, the various indentations and protrusions of the cam surface cause the locking ball 60 and the operating ball 62 to move either toward or away from central axis 40 along their respective paths which are parallel to lines 72 and 70, respectively.

Although not shown in FIG. 3, a switch such as that described above in conjunction with FIGS. 1 and 2, is attachable to the housing structure 14 in such a way that the plunger 12 of the switch is actuated by the switch operator 64. When the operating ball 62 moves downward relative to the housing structure 14 in response to movement of the cam structure 42, the switch operator 64 moves downward and protrudes through the outer surface of the housing structure 14. This pushes against the plunger of an associated switch and, if the switch is normally closed, deactuates it. Although not illustrated in FIG. 3, a cable can be attached to the end of shaft 16. This attachment can be accomplished in several ways, including a threaded eyelet which is threaded onto the outer surface of the leftmost end of the shaft 16 in FIG. 3.

In FIG. 3, the cam structure 42 is provided with a sharp rise 80 in its surface. As shown in the position represented in FIG. 3, the locking ball 60 is located to the left of the sharp rise 80 and maintains the cam structure 42 in a position that permits the operating ball 62 to move upward along line 70 and retract the switch operator 64. The position shown in FIG. 3 represents a condition when the cable actuated switching mechanism is at rest and the associated machinery is operating normally. In other words, the cable attached to the shaft 16 has not been pulled by an operator and has not broken. Two dimensions should be noted in FIG. 3. First, the dimension identified by arrow A illustrates the distance between the left most end of the cam structure 42 and the cam stop surface 52. This is the distance of allowable relative movement between the cam structure 42 and the shaft 16 before the cam structure is restricted from moving further toward the left relative to the shaft. Also, a smaller gap B is shown between the leftmost surface of the end stop 56 and the rightmost surface of the cam structure 42. Dimension B represents a slight gap between the end stop 56 and the cam structure 42. It also represents a slight relative movement that is possible between the cam structure 42 and the shaft 16.

If the shaft 16 is caused to move toward the left in FIG. 3 because of the cable being pulled by an operator, the end stop 56 will move through gap B and push against the cam structure 42 with sufficient force to overcome the resistance of the locking ball 60 and cause the locking ball 60 to roll over the sharp rise 80 in the cam surface. This will overcome the force of the locking spring 90 and cause the cam structure 42 to move toward the left. Subsequent to this momentary action caused by an operator pulling on the cable, the structure will be in the configuration shown in FIG. 4.

Figure 4:
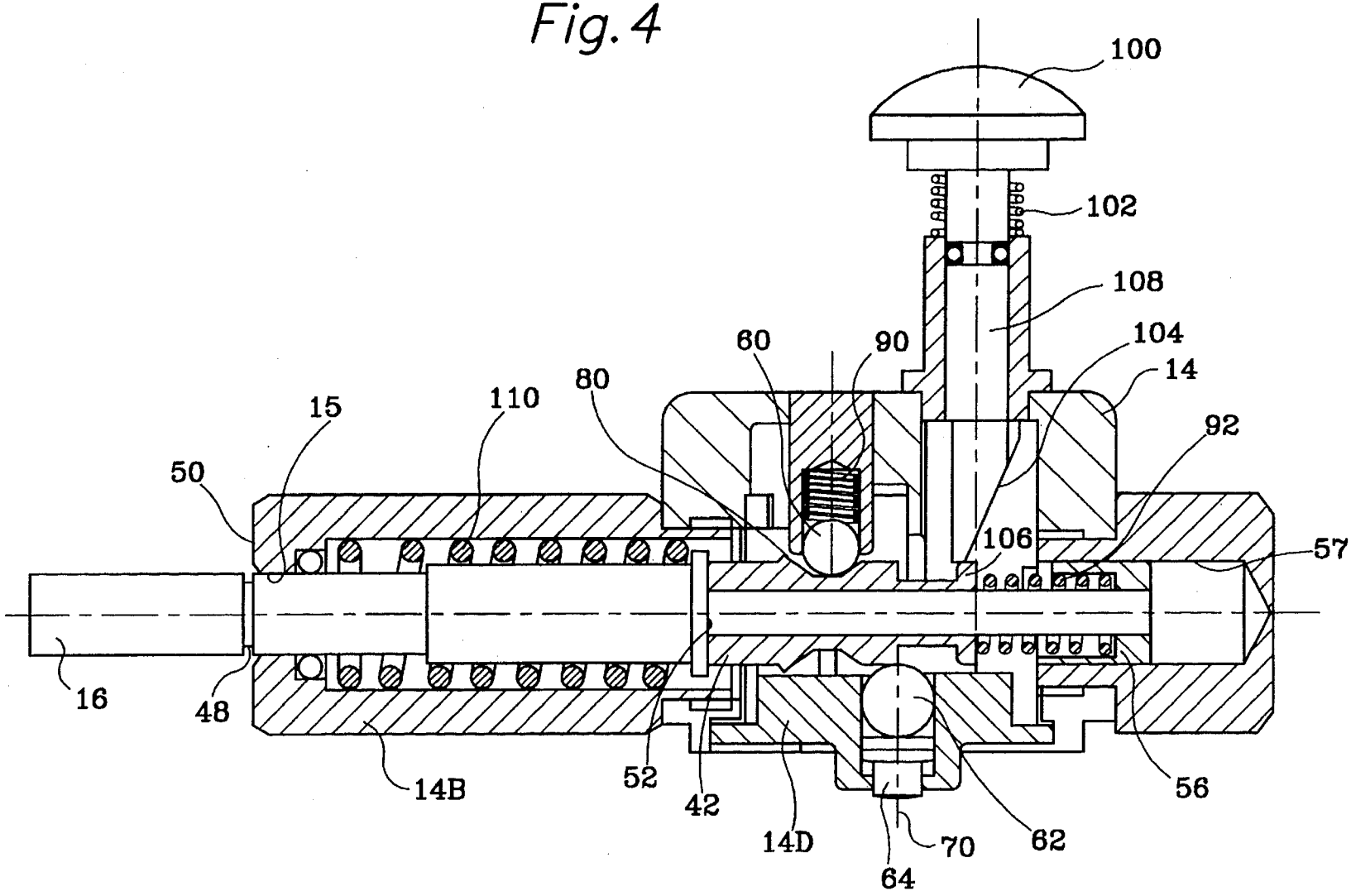
FIG. 4 is an illustration of the present invention subsequent to a deactuation operation caused by a pulling of an associated cable.

The locking ball 60 in FIG. 4 is in the depression formed to the right of the sharp rise 80 of the cam surface and the switch operator 64 is pushed downward by the operating ball 62 which, in turn, is pushed downward by the larger diameter portion of the cam surface as shown. The cam structure 42 is held in that general position by the combined action of the locking ball 60 and the cam spring 92. Upon release of the force on the cable, the shaft 16 returns to its normal position with the indicating groove 48 at its position proximate the end surface 50 of the housing structure. However, once the cam structure 42 is pushed toward its leftmost position by the end stop 56, as shown in FIG. 4, it is retained in that position by the locking ball 60 and, to some degree, by the cam spring 92. With the switch operator 64 protruding from the housing structure 14, an associated switch is deactuated. This condition is in response to the operator pulling the cable to indicate an emergency stop condition. Even after the cable is released, the position of the cam structure 42 exerts a downward force on the operating ball 62 end causes the switch operator 64 to remain in the position shown in FIG. 4. Once the cam structure 42 is placed in the position shown in FIG. 4, it must be manually reset by pushing the palm button 100 downward against the force of the reset spring 102 to cause the reset plunger cam surface 104 to move against the end portion 106 of the cam structure 42. A downward movement of the rest plunger 108 will cause the cam surface 104 to urge the cam structure 42 toward the right and permit the locking ball 60 to move upward along the ramp shown to its immediate left in FIG. 4 and rise above the sharp rise 80 in the cam surface. This will place the locking ball 60 on the left side of the sharp rise 80 and reset the mechanism to the condition shown in FIG. 3. Until the manual reset is accomplished in this manner, the switch operator 64 will continue to protrude from the housing structure 14 and deactuate the associated switch. When the reset is accomplished, the operating ball 62 will move back to the position between the two enlarged portions of the diameter of the cam structure 42, as shown in FIG. 3, and the switch operator 64 will be retracted into the housing 14. This will actuate the associated switch.

Figure 5:
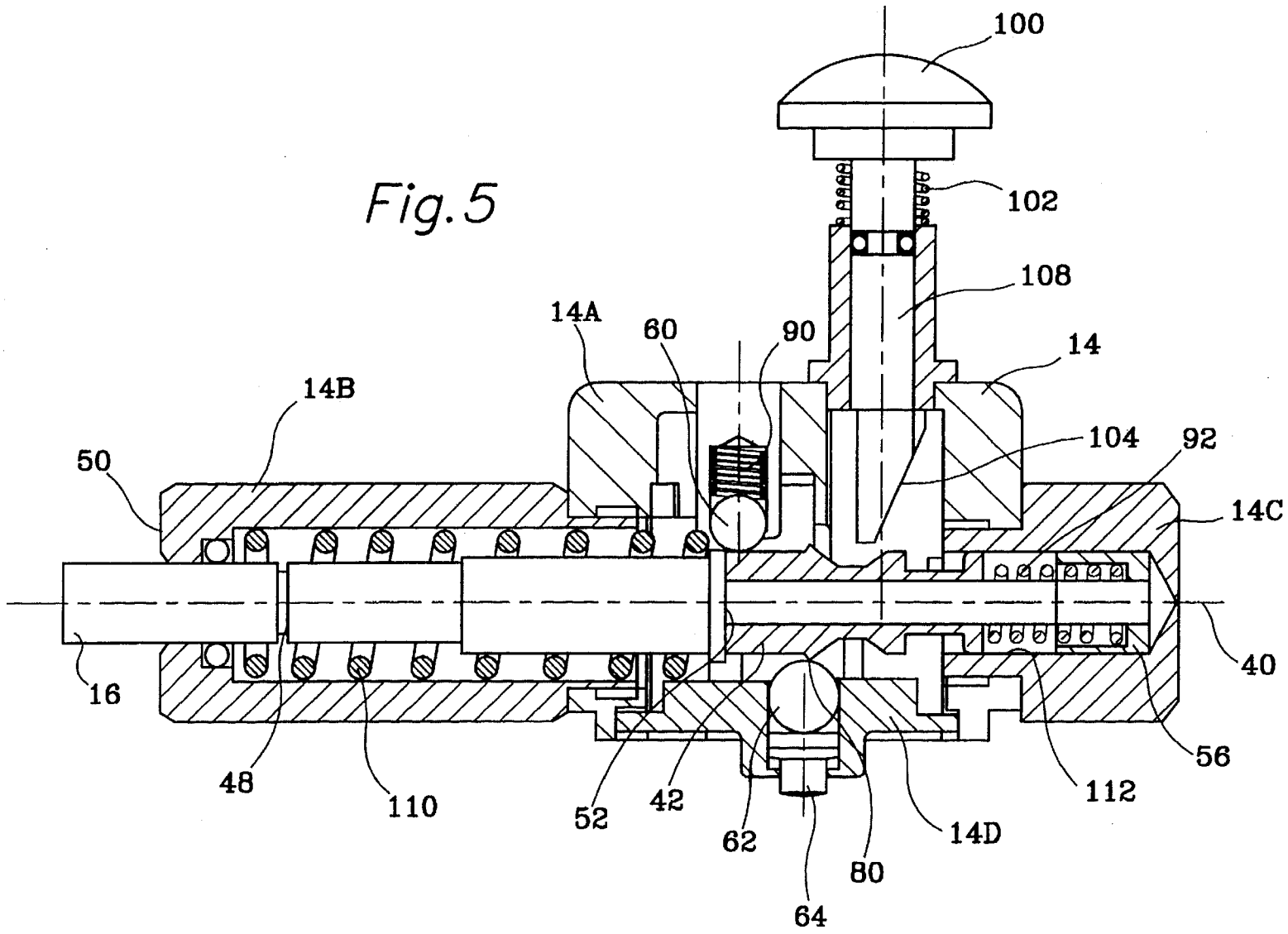
FIG. 5 is an illustration of the present invention following the breaking of a cable.

FIG. 5 illustrates the condition of the present invention following a broken cable condition. Without the force on the shaft 16 that is normally provided by the normal cable tension, the cable tension spring 110 pushes against the left side of the shaft enlargement that also provides the cam stop surface 52 and urges the shaft 16 toward the right relative to the housing structure 14. The end stop 56 moves to its rightmost position within the bore 112 and the cam spring 92 urges the cam structure 42 against the cam stop surface 52 of the shaft. This places the sharp rise 80 of the cam surface against the operating ball 62 and pushes the switch operator 64 downward relative to the housing structure 14. When in this position, the switch operator 64 will deactuate the associated switch. The only means for recovering from the situation shown in FIG. 5 is to attach the cable to its proper mooring, as shown in FIG. 2. If the cable had been broken, a new cable would be used to replace it and the tension on the cable would be adjusted to place the indicating groove 48 at its proper position relative to the end surface 50.

With reference to FIGS. 3, 4 and 5, it should be understood that the representation of FIG. 3 shows the present invention in its normal operating condition. FIG. 4 shows the present invention after the cable has been pulled by an operator to indicate an emergency stop condition. FIG. 5 shows the present invention following a broken cable condition. FIGS. 4 and 5 show the present invention in situations where the associated switch is deactuated to prevent power from being provided to machinery that could possibly cause damage or harm to an operator. With reference to FIG. 3, it is also important to note that gaps A and B provide a certain amount of axial movement of the shaft 16 relative to the cam structure 42 that can be caused by changes in temperature which, in turn, cause the cable to expand and contact. This small amount of expansion and contraction can be accommodated by the gaps identified as A and B in FIG. 3. Since it is more likely that the cable will experience rising temperatures above normal ambient than falling temperatures below normal ambient, gap A is provided to be larger than gap B. However, it should clearly be understood that the selection of the relative dimensions of gaps A and B can be changed to suit alternative conditions.

When cable actuated switching mechanisms are used, it is desirable that the control circuit contacts of the switch remain open until manually reset after they are opened during an emergency stop condition. It is also desirable that the control contacts of the switch open when the cable either is broken or becomes slack beyond its useful operating tension. The control circuit contacts of the switch should also be a direct acting or a positive break design so that the mechanical force from pulling the cable will open the contacts in the event that they become welded during operation. The mechanism should also allow for some degree of expansion and contraction of the cable due to changes in the temperature.

Although the present invention can be used in conjunction with a snap acting switch, it should clearly be understood that the mechanical snap action of the present invention makes it unnecessary to use a snap acting switch in all cases. The present invention shown in FIGS. 3, 4 and 5 can also be associated with a slow acting switch that uses direct acting contact blocks. With continuing reference to FIGS. 3, 4 and 5, FIG. 3 shows the present invention in its normal operating position. The switch operator, or operating plunger 64 transfers the actuation motion from the mechanical action of the mechanism to the switch that is associated with the switch operator 64. Although not shown in FIGS. 3, 4 and 5, a cable is attached to the end of the shaft 16 which protrudes from the housing structure beyond surface 50. The cable tension spring 110 maintains an appropriate tension on the cable after it is attached to a stationary fixture at its opposite end. When the cable is properly attached and the cam structure 42 is in the position shown in FIG. 3, the contacts of the normally closed switch will be closed. Tension adjustment on the cable is typically made via a turnbuckle. The cam structure 42 can slide relative to the shaft 16 between limits set by the cam stop surface 52 and the left surface of the end stop 56. The cam structure 42 will be moved toward the left by the cam spring 92 until the sharp rise 80 of the cam surface moves against the locking ball 60. The cam structure 42 will be maintained in the position shown in FIG. 3 until either the cable is pulled to move the shaft 16 toward the left or the cable breaks to move the shaft 16 toward the right.

When the cable is pulled, the shaft will slide inside the cam structure 42 until there is no longer a gap B between the end stop 56 and the cam structure 42. Further movement of the shaft 16 will cause the cam structure 42 to move with the shaft 16 until the locking ball 60 is forced over the sharp rise 80 of the cam structure and rests on the downward slope of the cam between its two larger diameters. The locking ball 60 is placed, by the above described action, at a position where it applies a force to the cam in the same direction as the cam spring 110. At this point, the operating ball 62 rests against the cam rise and a component of force is applied to the contact block of an associated switch by the switch operator 64. This force will be less than, and in a direction opposite to, those forces generated by the cam spring 110 and the locking ball 60. The net force causes the cam structure 42 to slide along the shaft 16 and force the operating ball 62 up the cam rise toward its rightmost larger diameter portion of the cam structure 42. Once the cable is released by the operator, there is sufficient gap between the cam structure 42 and the cam stop surface 52 to allow the shaft to return to its original position without moving the cam structure 42. This condition is shown in FIG. 4. With the shaft in its original position following the pulling of the cable, as represented in FIG. 4, the flanged end portion of the cam structure is aligned with the reset plunger 108. A downward movement of the reset plunger 108 will cause the cam surface 104 to push against the enlarged diameter 106 of the cam structure 42. This downward movement of the plunger will move the cam structure 42 toward the right and reset the mechanism.

FIG. 6 is an enlarged view of the right end of the cam structure 42 shown in FIGS. 3, 4 and 5. The enlarged diameter 130 at the right end of the cam structure 42 is provided with a rounded surface 132 to facilitate the operation of the present invention when the plunger 108 is pushed downward to cause the plunger's cam surface 104 to engage the enlarged diameter 130 of the cam structure. If, alternatively, a sharp edge is provided at the left portion of the enlarged diameter 130, galling between the sharp edge and the cam surface 104 of the plunger is possible. In order to prevent this galling, the rounded surface 132 is provided with an effective radius of approximately 0.030 inches. When the plunger 108 is pushed downward as described above, to reset the present invention, the rounded portion 132 moves against the cam surface 104 to push the cam structure 42 toward the right.

In the terminology used to describe the claimed invention, the housing structure 14 comprises four portions that are assembled together. These portions are identified by reference numerals 14A, 14B, 14C and 14D. The shaft 16 is slideably disposed within the housing structure 14 and is movable relative to the housing structure along a first path in a direction parallel to the axial centerline 40 of the shaft. This movement is in response to a force exerted by a cable which is identified by reference numeral 30 in FIG. 2. The cable 30 is attached to the left end of the shaft 16 shown in FIGS. 3, 4 and 5. A cam structure 42 has an opening 44 formed therethrough. The opening 44 and is shaped to receive the shaft 16 therein in slideable relation with the cam structure 42. As shown in FIG. 3, the cam structure 42 can slide axially on the shaft 16 between the limits set by the cam stop surface 52 and the left surface of the end stop 56. A switch operator 64 is movable along a second path which is parallel to line 70 in FIG. 3. The movement along the second path is between a first position as shown in FIG. 3, with the switch operator contained within the housing structure 14, and a second position shown in FIG. 4 with the switch operator extending from the housing structure 14. This movement is in response to movement of the cam structure 42 in either a first direction toward the left in FIG. 3 or a second direction toward the right in FIG. 3. These movements in the first direction or second direction are along the first path which is, in turn, parallel to the central axis 40 of the shaft 16. The means for locking the switch operator 64 in the second position after the switch operator 64 moves into the second position is provided by the locking ball 60 in cooperation with the surface of the cam structure 42. The movement of the switch operator 64 into the second position, as shown in FIGS. 4 and 5, can result from either of two causes. The first cause is an increased force by the cable on the shaft 16. This can be caused by the operator pulling the cable. When the cable is pulled with a sufficient force to overcome the cable tension spring 110, the shaft 16 is moved to the left. This places the present invention in the configuration shown in FIG. 4. The locking ball 60 is then disposed between the two enlarged diameter portions of the cam structure 42, as shown in FIG. 4, and the cam structure 42 is locked in the position to hold the switch operator 64 in the extended downward position. The other possible cause for the switch operator 64 moving into the extended downward position is the breaking of the cable. This result is illustrated in FIG. 5.

The electrical switch described above in conjunction with FIGS. 1 and 2 can be attached to the structure shown in FIGS. 3, 4 and 5. The switch is actuated when the switch operator 64 is in the second position that is shown in FIGS. 4 and 5. The electrical switch can be deactuated when the switch operator is in the first position shown in FIG. 3.

The present invention can further comprise a first means for moving the cam structure in the first direction, toward the left in FIGS. 3, 4 and 5, in order to move the switch operator 64 into the second position in response to the force on the cable increasing beyond a first threshold magnitude. That first threshold magnitude is the force required to overcome the effect of the cable tension spring 110 and the other residual forces caused by the interaction of the components within the housing structure. In addition, the present invention can comprise the second means for moving the cam structure 42 in the second direction toward the right in FIGS. 3, 4 and 5 in order to move the switch operator 64 into the second position in response to the force of the cable on the shaft 16 decreasing beyond a second threshold magnitude. That second threshold magnitude is the force necessary to balance the force of the cable tension spring. When that force decreases beyond the second threshold magnitude in response to a broken cable, the cable tension spring moves the shaft toward the right as illustrated in FIG. 5. The first moving means can comprise a first enlarged portion of the shaft 16 which is shaped to push the cam structure in the first direction toward the left in response to movement of the shaft 16 in that first direction toward the left. This structure is the end stop 56 shown in FIGS. 3, 4 and 5. The second moving means described above can comprise a second enlarged portion of the shaft which is shaped to push the cam structure 42 in the second direction toward the right in response to movement of the shaft in that second direction. This second moving means comprises the cam stop surface 52. As described above, the second moving means can further comprise the cable tension spring 110 for pushing the shaft in the second direction toward the right in response to the force of the cable decreasing beyond the second threshold magnitude.

The means for resetting the mechanism has been described above and includes the plunger 108, the palm button 100 and the plunger cam surface 104. It urges the cam structure 42 in the first direction toward the left in order to move the switch operator from the second position to the first position which is retracted into the housing structure 14. The first path, which is parallel to the central axis 40, can be perpendicular to the second path which is parallel to line 70 in a preferred embodiment of the present invention. The switch operator 64 can comprise a cam follower which is identified as the operating ball 62. The cam follower is disposed in contact with the surface of the cam structure 42. The locking means comprises the locking ball 60 which is disposed in contact with the surface of the cam structure 42.

Figure 7:
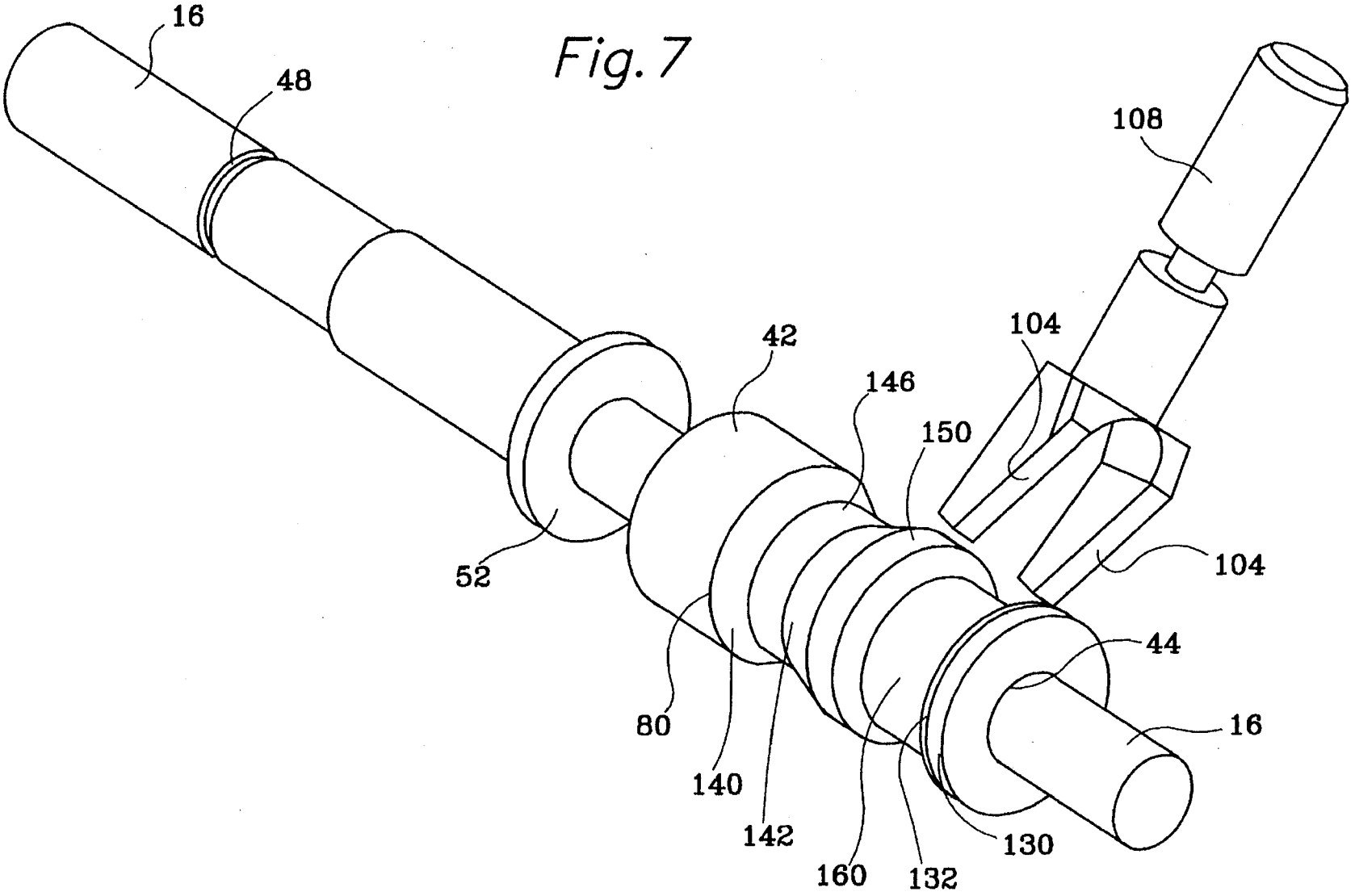
FIG. 7 is a perspective view of the shaft, the cam structure and the reset plunger of the present invention.

FIG. 7 is a perspective view of the shaft 16 and the cam structure 42 illustrated in association with the reset plunger 108. For purposes of clarity, the housing structure 14 is not illustrated in FIG. 7. Furthermore, the end stop 56, the cam spring 92 and the cable tension spring 110 are not shown in FIG. 7. The cam structure 42 is provided with several diameters that each serve a particular purpose in a cable switch actuator made in accordance with the present invention. The structure shown in FIG. 7 will be described in terms of the components illustrated in FIGS. 3, 4 and 5. Immediately to the right of the sharp rise 80 of the cam structure 42 is a sloped surface 140. Between sloped surface 140 and an oppositely sloped surface 142 is a reduced diameter 146. When the cam structure 42 is in the position shown in FIG. 4, the locking ball 60 is held between sloped surfaces 140 and 142 to retain the cam structure in the position that depresses the operating ball 62 and pushes the switch operator 64 downward. The diameter of surface 150 is approximately equal to the diameter of the sharp rise 80. Between the portion of the cam structure 42 identified by reference numeral 150 and the portion identified by reference numeral 130, a reduced diameter portion 160 is provided. This reduced diameter portion 160 is shaped to pass between the two arms of the plunger 108 on which the cam surfaces 104 are provided. The space between the two arms of the plunger structure permits the plunger to pass downward over the cam structure 42 and allows the cam surfaces 104 to push against the rounded surface 132 of the cam structure. As described in greater detail above, this action between the rounded surface 132 and the cam surfaces 104 pushes the cam structure 42 toward the right to reset the mechanism. The shaft 16 is slideably disposed within the opening 44 of the cam structure to permit it to slide axially in a direction parallel to the central axis 40.

As described above, the present invention solves several problems that are present in known cable actuation mechanisms. It provides a mechanical snap action mechanism that locks the cam structure in position to maintain the switch operator 64 in an extended downward position after the cable is pulled momentarily. This snap action, or locking action, is performed mechanically and is effective whether the switch is a snap acting switch or a slow acting switch. The present invention also reacts to a broken cable by causing the switch operator 64 to move downward and deactuate the switch. In addition, the present invention locks the cam structure 42 in the deactuating position whether it is moved into the deactuating position because of a pull by an operator on the cable or because of a broken cable. Regardless of the direction of movement of the cam actuator 42 which deactuates the switch, the cam actuator is locked into the deactuating position until it is reset or until the cable is repaired. In addition, the gaps provided between the cam structure 42 and the two operative surfaces of the shaft 16 permit temperature changes in the cable to change its length without adversely affecting the operation of the mechanism.

Although the present invention has been described with particular detail to illustrate a preferred embodiment of the present invention, it should be understood that alternative embodiments are within its scope.

The embodiments of the invention in which an exclusive property or right is claimed are defined as follows:

1. A cable actuated switching mechanism, comprising:

a housing structure;

a shaft slideably disposed within said housing structure, said shaft being movable relative to said housing structure along a first path in a direction parallel to an axial centerline of said shaft in response to a force exerted by a cable attached to an end of said shaft;

a cam structure having an opening formed therethrough, said opening being shaped to receive said shaft therein in slideable relation with said cam structure;

a switch operator which is movable along a second path between a first position and a second position in response to movement of said cam structure in either a first direction or a second direction parallel to said first path; and means for locking said switch operator in said second position after said switch operator moves into said second position.

2. The mechanism of claim 1, further comprising;

an electrical switch attached to said housing structure, said switch being actuated when said switch operator is in said second position and deactuated when said switch operator is in said first position.

3. The mechanism of claim 1, further comprising:

first means for moving said cam structure in said first direction in order to move said switch operator into said second position in response to said force increasing beyond a first threshold magnitude; and second means for moving said cam structure in said second direction in order to move said switch operator into said second position in response to said force decreasing beyond a second threshold magnitude.

4. The mechanism of claim 3, wherein:

said first moving means comprises a first enlarged portion of said shaft which is shaped to push said cam structure in said first direction in response to movement of said shaft in said first direction.

5. The mechanism of claim 3, wherein:

said second moving means comprises a second enlarged portion of said shaft which is shaped to push said cam structure in said second direction in response to movement of said shaft in said second direction.

6. The mechanism of claim 5, wherein:

said second moving means further comprises a spring for pushing said shaft in said second direction in response to said force decreasing beyond said second threshold magnitude.

7. The mechanism of claim 1, further comprising:

means for resetting said mechanism by urging said cam structure in said first direction in order to move said switch operator from said second position to said first position.

8. The mechanism of claim 1, wherein:

said first path is perpendicular to said second path.

9. The mechanism of claim 1, wherein:

said switch operator comprises a cam follower disposed in contact with said cam structure.

10. The mechanism of claim 1, wherein:

said locking means comprises a sphere disposed in contact with said cam structure.

11. A cable actuated switching mechanism, comprising:

a housing structure;

a shaft slideably disposed within said housing structure, said shaft being movable relative to said housing structure along a first path in a direction parallel to an axial centerline of said shaft in response to a force exerted by a cable attached to an end of said shaft;

a cam structure having an opening formed therethrough, said opening being shaped to receive said shaft therein in slideable relation with said cam structure;

a switch operator which is movable along a second path between a first position and a second position in response to movement of said cam structure in either a first direction or a second direction parallel to said first path;

means for locking said switch operator in said second position after said switch operator moves into said second position; and an electrical switch attached to said housing structure, said switch being actuated when said switch operator is in said second position and deactuated when said switch operator is in said first position.

12. The mechanism of claim 11, further comprising:

first means for moving said cam structure in said first direction in order to move said switch operator into said second position in response to said force increasing beyond a first threshold magnitude; and second means for moving said cam structure in said second direction in order to move said switch operator into said second position in response to said force decreasing beyond a second threshold magnitude.

13. The mechanism of claim 12, wherein:

said first moving means comprises a first enlarged portion of said shaft which is shaped to push said cam structure in said first direction in response to movement of said shaft in said first direction.

14. The mechanism of claim 12, wherein:

said second moving means comprises a second enlarged portion of said shaft which is shaped to push said cam structure in said second direction in response to movement of said shaft in said second direction.

15. The mechanism of claim 14, wherein:

said second moving means further comprises a spring for pushing said shaft in said second direction in response to said force decreasing beyond said second threshold magnitude.

16. The mechanism of claim 11, further comprising:

means for resetting said mechanism by urging said cam structure in said first direction in order to move said switch operator from said second position to said first position.

17. The mechanism of claim 11, wherein:

said first path is perpendicular to said second path.

18. The mechanism of claim 11, wherein:

said switch operator comprises a cam follower disposed in contact with said cam structure.

19. The mechanism of claim 11, wherein:

said locking means comprises a sphere disposed in contact with said cam structure.

20. A cable actuated switching mechanism, comprising:

a housing structure;

a shaft slideably disposed within said housing structure, said shaft being movable relative to said housing structure along a first path in a direction parallel to an axial centerline of said shaft in response to a force exerted by a cable attached to an end of said shaft;

a cam structure having an opening formed therethrough, said opening being shaped to receive said shaft therein in slideable relation with said cam structure;

a switch operator which is movable along a second path between a first position and a second position in response to movement of said cam structure in either a first direction or a second direction parallel to said first path;

means for locking said switch operator in said second position after said switch operator moves into said second position;

an electrical switch attached to said housing structure, said switch being actuated when said switch operator is in said second position and deactuated when said switch operator is in said first position;

first means for moving said cam structure in said first direction in order to move said switch operator into said second position in response to said force increasing beyond a first threshold magnitude;

second means for moving said cam structure in said second direction in order to move said switch operator into said second position in response to said force decreasing beyond a second threshold magnitude, said first moving means comprises a first enlarged portion of said shaft which is shaped to push said cam structure in said first direction in response to movement of said shaft in said first direction, said second moving means comprises a second enlarged portion of said shaft which is shaped to push said cam structure in said second direction in response to movement of said shaft in said second direction, said second moving means further comprises a spring for pushing said shaft in said second direction in response to said force decreasing beyond said second threshold magnitude; and means for resetting said mechanism by urging said cam structure in said first direction in order to move said switch operator from said second position to said first position, said first path is perpendicular to said second path, said switch operator comprises a cam follower disposed in contact with said cam structure, said locking means comprises a sphere disposed in contact with said cam structure.

* * * * *